US006267354B1

(12) United States Patent
Stephen

(10) Patent No.: US 6,267,354 B1
(45) Date of Patent: Jul. 31, 2001

(54) SEPARATING DEVICE

(75) Inventor: Robert Stephen, Peterhead (GB)

(73) Assignee: Future Alignments Limited, Aberdeenshire (GB)

( * ) Notice: Subject to any disclaimer, the term of this patent is extended or adjusted under 35 U.S.C. 154(b) by 0 days.

(21) Appl. No.: 09/403,147

(22) PCT Filed: Apr. 17, 1998

(86) PCT No.: PCT/GB98/01121

§ 371 Date: Oct. 15, 1999

§ 102(e) Date: Oct. 15, 1999

(87) PCT Pub. No.: WO98/47809

PCT Pub. Date: Oct. 29, 1998

(30) Foreign Application Priority Data

Apr. 18, 1997 (GB) ..... 9707911
Sep. 3, 1997 (GB) ..... 9718594

(51) Int. Cl.[7] ..... B66F 3/24
(52) U.S. Cl. ..... 254/93 R; 254/133 R; 254/104
(58) Field of Search ..... 254/93 R, 42, 254/104, 133 R, 131, 98

(56) References Cited

U.S. PATENT DOCUMENTS 1,407,719 * 2/1922 Boner ..... 254/133 R
2,259,932 * 10/1941 Hejduk et al. ..... 254/104
3,883,178 5/1975 Darda .
4,299,347 11/1981 Rougier .
5,374,033 * 12/1994 Tilman ..... 254/104
5,622,353 * 4/1997 Painter et al. ..... 254/93 R
6,000,680 * 12/1999 Kimura et al. ..... 254/93 R

FOREIGN PATENT DOCUMENTS 0 302 388 2/1989 (EP) .
2 231 607 12/1974 (FR) .
92/14674 9/1992 (WO) .

* cited by examiner

*Primary Examiner*—Joseph J. Hail, III
*Assistant Examiner*—Lee Wilson
(74) *Attorney, Agent, or Firm*—Ratner & Prestia

(57) ABSTRACT

A separating device is provided that includes a wedge-shaped member. The wedge-shaped member has a plate member attached to each tapering side of it, and it may be moved linearly towards its apex. When moved in this way, the plate members move in a direction substantially perpendicular to the direction of movement of the wedge-shaped member. In use, the leading edge of the device is inserted between two objects (one of which may be the ground) and thus, when the plate members are moved apart by movement of the wedge-shaped member towards is apex, the objects are consequently moved apart (or one is lifted).

22 Claims, 7 Drawing Sheets

SEPARATING DEVICE

FIELD OF THE INVENTION

The invention relates to a separating device.

DESCRIPTION OF THE RELATED ART

Hydraulic lifting and separating wedges are known. These wedges usually consist of a central wedge-shaped portion located between two external plates. The external plates are located between the objects to be separated or under the object to be lifted. The wedge is driven forward between the two plates in order to push the plates apart, thereby separating the objects or lifting the object.

Generally, the plates are coupled to the wedge by a form of pivotal connection which retains the plates on the wedge but permits the wedge to move with respect to the plates in order to separate them.

These pivotal connections have the disadvantage that the plates rotate about the pivots describing a rotational movement and do not move directly in the direction of the separation forces exerted by the wedge on the plates. Alternatively, the plates require pivoting linkages in order to enable the plates to move linearly rather than rotationally.

BRIEF SUMMARY OF THE INVENTION

According to the present invention there is provided a separating device comprising a wedge-shaped member mounted on a body member for movement in a direction towards and/or away from the apex of the wedge-shaped member, at least one plate member capable of movement in a direction substantially perpendicular to the direction of movement of the wedge-shaped member, and a linear drive mechanism to move the wedge-shaped member relative to the body member.

Preferably, there are two plate members located on opposite tapering surfaces of the wedge-shaped member.

Preferably, the plate members are constrained to move only in a direction substantially perpendicular to the direction of movement of the wedge-shaped member, for example by a pin and slot arrangement.

Preferably, the plate members are slidably coupled to the body member. Preferably also, the plate members are slidably coupled to the wedge-shaped member. Preferably, the linear drive mechanism is coupled to the wedge-shaped member.

Preferably, the plate members extend across a tapered surface of the wedge and have legs which extend down the sides of the wedge. Typically, the plate members (via the legs) are slidably coupled to the body member by a first pin and slot arrangement. Typically also, the plate members (via the legs) are slidably coupled to the wedge-shaped member by a second pin and slot arrangement.

Typically, the plate members include a stepped outer surface, the steps originating at the leading edge of the device and increasing in size towards the body member.

Preferably, the first step at the leading edge of the device is provided with an interlocking mechanism, such that one of the plate members interfits with the other of the plate members. Preferably, the plate members have castellated front edges such that when the plate members are brought together, the castellations interfit.

This configuration has the advantage that the thickness of the leading edge of the device can be reduced whilst its strength is increased, allowing for an increase in the force which the device is capable of exerting. It will be appreciated that if the maximum force is not required for a particular application, then the thickness of the leading edge of the device may be reduced further. Typically, the interlocking feature allows the thickness of the leading edge to be reduced from 15 mm to 6 mm whilst retaining the same capacity for expansive force.

Preferably, the first pin and slot arrangement comprises a pin in one of the plate member and the body member which engages with a corresponding slot in the other of the plate member and the body member.

Preferably, the second pin and slot arrangement comprises at least one pin, and most preferably two pins, on each inner face of the legs of the plate members both of which engage a single slot formed in the wedge-shaped member. Preferably, the slot in the wedge-shaped member extends parallel to the tapered surfaces of the wedge-shaped member. Typically, the interengagement of the second pin with the second slot promotes retraction of the plate members as the wedge member is retracted using the drive mechanism without any external force being applied to the plate members such as by hand, for example. The slots on the wedge member act as a guide and the retractive force applied by the ram acts on the pins, via the guide slot, to pull the plate members together.

Alternatively, the pins may be on the wedge-shaped member and the slots may be on the plate members.

Typically, two of the first pin and slot arrangements are provided for each plate member, one pin and slot arrangement being located on each side of the wedge-shaped member. Typically also, two of the second pin and slot arrangements are provided for each plate member, one arrangement associated with each inner face of the legs of the plate members.

Typically, the plate members move in parallel but opposite directions.

In one example of the invention, the drive mechanism may comprise a hydraulic ram. In another example of the invention, the drive mechanism may comprise a threaded stud which engages with a screw thread in the body member and is coupled to the wedge-shaped member to provide for rotation of the threaded stud relative to the wedge-shaped member. Hence, rotation of the threaded stud causes a linear movement of the wedge towards or away from the body member.

BRIEF DESCRIPTION OF THE SEVERAL VIEWS OF THE DRAWINGS

Embodiments of the present invention will now be described, by way of example only, with reference to the accompanying drawings in which.

DETAILED DESCRIPTION OF THE INVENTION

Figure 1:
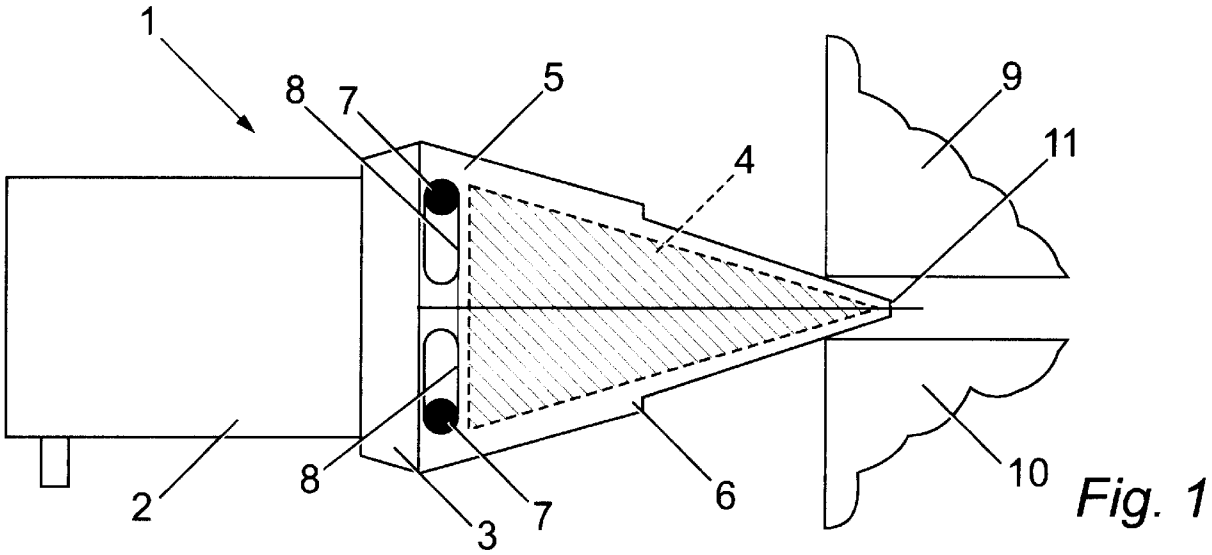
FIG. 1 is a side view of a hydraulically operated separation device, in use and in a first position.

FIG. 1 shows a hydraulic separation device 1 which includes a hydraulic ram mechanism 2, a body member 3, a wedge-shaped member 4 (shown in phantom in FIG. 1) and two generally U-shaped plates 5, 6. The hydraulic ram mechanism 2 is fixed to the body member 3 which has four pins 7 (only two shown) which project from the sides of the body member and engage in four corresponding slots 8 (only two shown) in each side of the U-shaped plates 5, 6. The wedge-shaped member 4 is located within the U-shaped plates (5, 6) and is coupled to a ram (not shown) on the hydraulic ram mechanism 2.

As shown in FIG. 1, the separation device 1 may be used to separate two objects 9, 10 by inserting apex portion 11 of the separation device 1 between the objects 9, 10.

Figure 2:
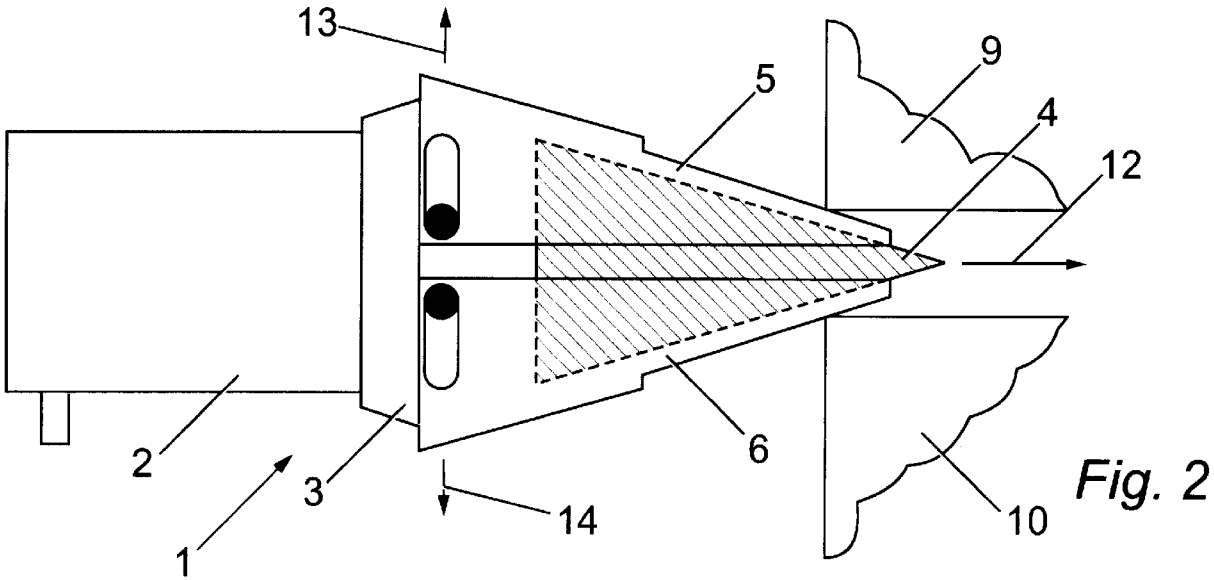
FIG. 2 is a side view of the hydraulic separation device shown in FIG. 1, in use and in a second position.

As shown in FIG. 2, operation of the hydraulic ram mechanism 2 pushes the wedge 4 in the direction of the arrow 12. This causes the wedge 4 to move the U-shaped plate 5 in the direction of the arrow 13 and the U-shaped plate 6 in the direction of the arrow 14 so that the slots 8 move along the pins 7. The movement of the plates 5, 6 separates the objects 9, 10. It should be noted that as the U-shaped plates 5, 6 are moved linearly with respect to the body member 3 and substantially perpendicularly to the movement 12 of the wedge 4, the U-shaped plates 5, 6 remain stationary with respect to each respective object 9, 10. However, the wedge 4 moves with respect to both objects.

Figure 3:
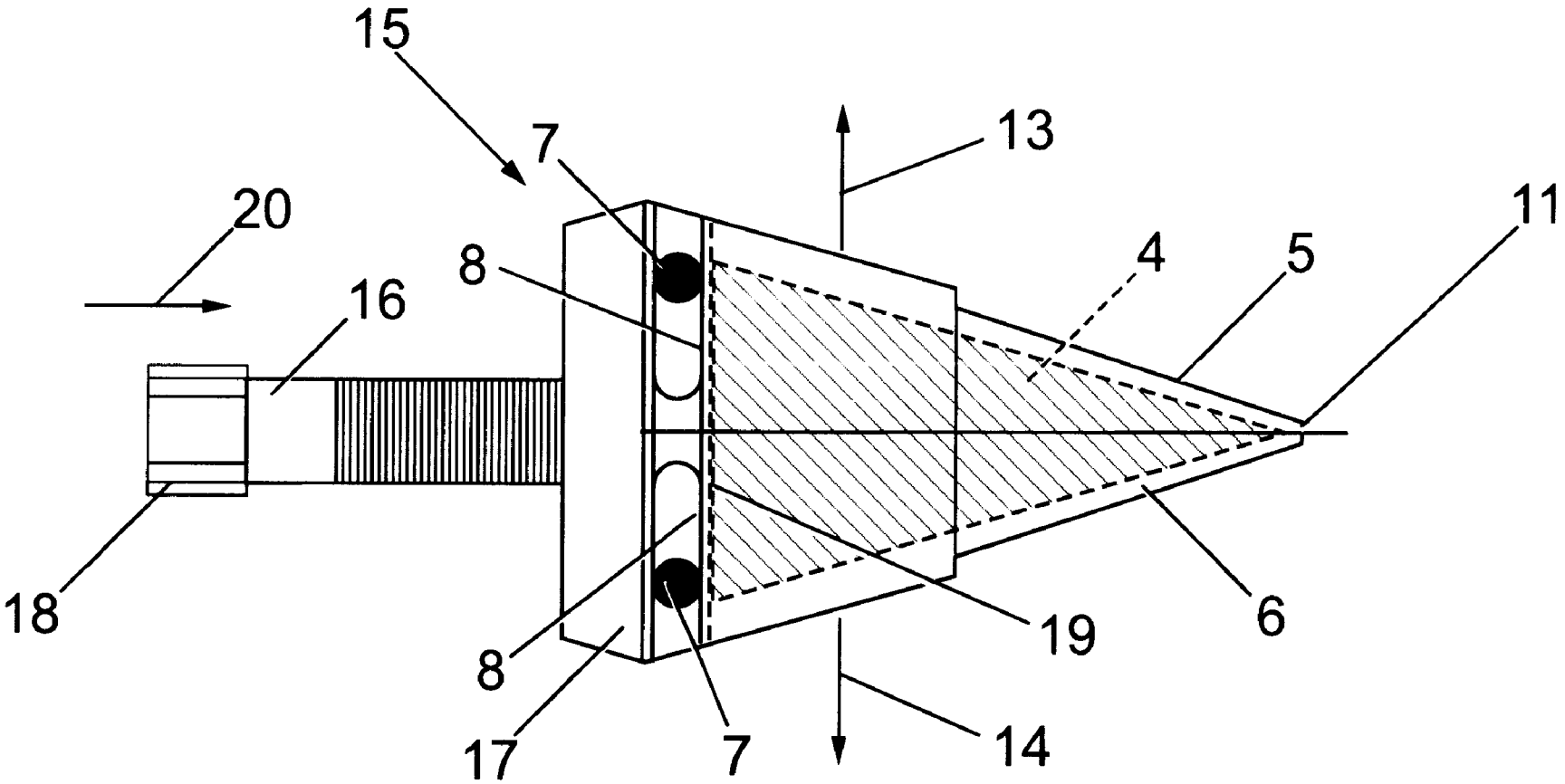
FIG. 3 is a side view of a manually operated separation device.

An example of a manually operated separating device 15 is shown in FIG. 3.

In FIG. 3, the wedge-shaped member 4 and the U-shaped plates 5, 6 are the same as that used for the hydraulic separation device 1 shown in FIGS. 1 and 2 and the pins 7 and slots 8 are also the same as in the hydraulic separation device 1.

However, the hydraulic ram mechanism 2 is replaced with a threaded stud 16 having a bolt head 18 and a body member 17 is threaded to receive the threaded stud 16. The threaded stud 16 is coupled to rear side 19 of the wedge 4 by a coupling which permits the stud 16 to rotate with respect to the wedge 4 and so that linear movement of the threaded stud 16 in the direction of the arrow 20 moves the wedge 4 in the same direction as the arrow 20. Hence, turning of the threaded stud 16 by means of the head 18, while retaining the body member 17 stationary, causes the wedge 4 to move in the direction of the arrow 20 to generate movement of the U-shaped plates 5, 6 in the direction of the arrows 13, 14 respectively.

Hence, the manual separation device 15 can be used in a similar manner to the separation device 1 to separate two objects 9, 10.

In addition, if the object 10 is stationary then operation of the devices 1, 15 will cause the object 9 to be lifted away from the top surface of the object 10.

An advantage of the invention is that by providing linear movement of the U-shaped members 5, 6 in a direction perpendicular to the linear movement of the wedge 4, permits the U-shaped plates 5, 6 to remain stationary with respect to the object the respective plate is in contact with during lifting or separation. In addition, the requirement for rotational or pivotable coupling of the plates 5, 6 to the body member 3, 17 is obviated.

Figure 4:
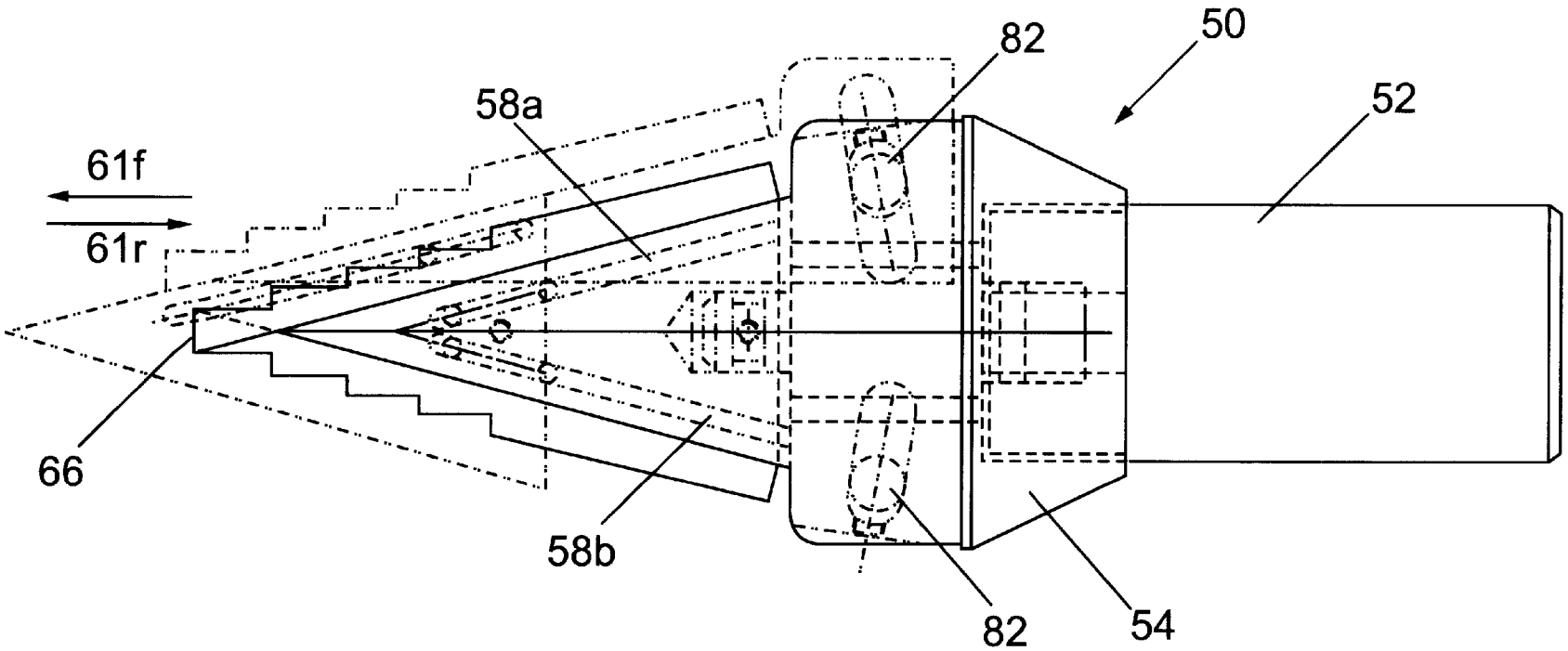
FIG. 4 is a plan of an alternative hydraulically operated separation device.
Figure 5A:
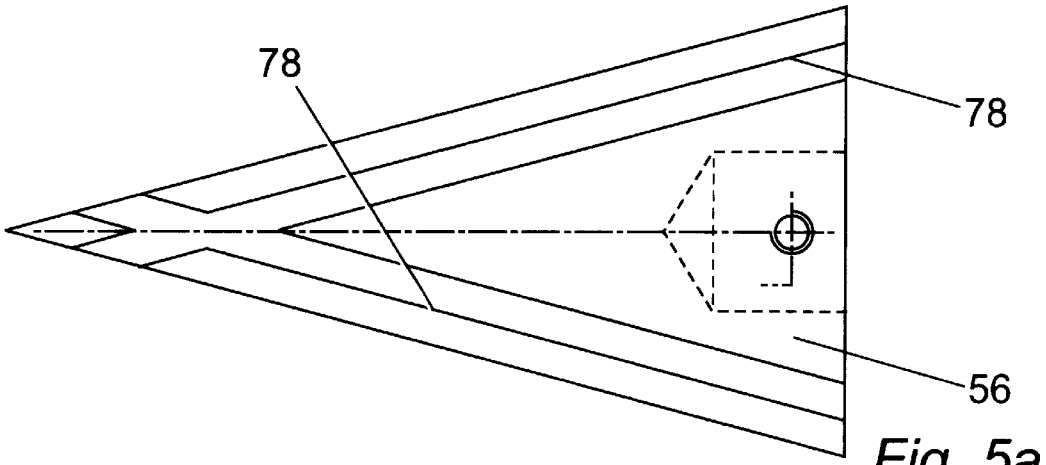
FIGS. 5*a* and 5*b* are plan and side views respectively of a wedge-shaped member for use with the device of FIG. 4.
Figure 5B:
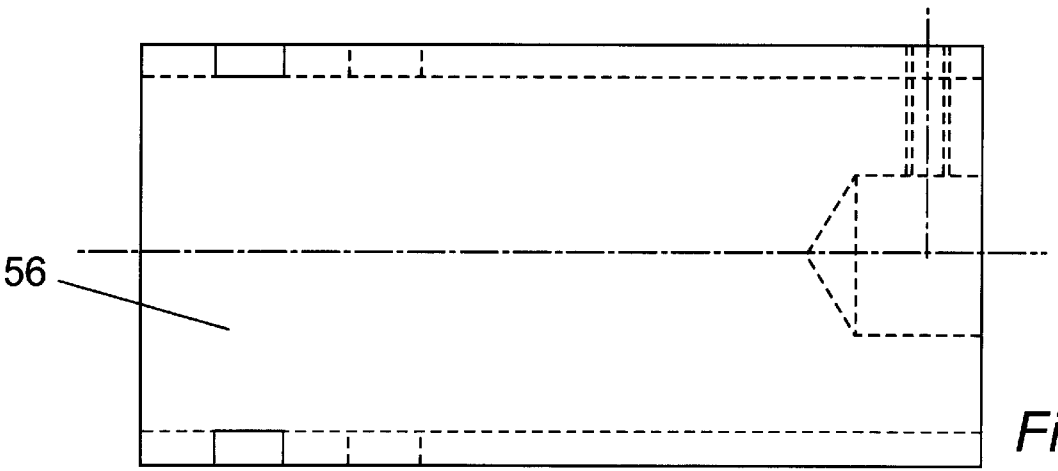

Referring now to FIG. 4 there is shown an alternative form of a separation device 50 according to the present invention. The device 50 includes a hydraulic ram mechanism 52 which is coupled to a body member 54. The ram 52 acts on a wedge 56 (see FIGS. 5*a* and 5*b*) to move the wedge 56 in a direction towards and/or away from the apex of the wedge 56.

Two plate members 58*a*, 58*b* are located on the tapering faces of the wedge 56 and are slidably coupled thereto.

Figure 6A:
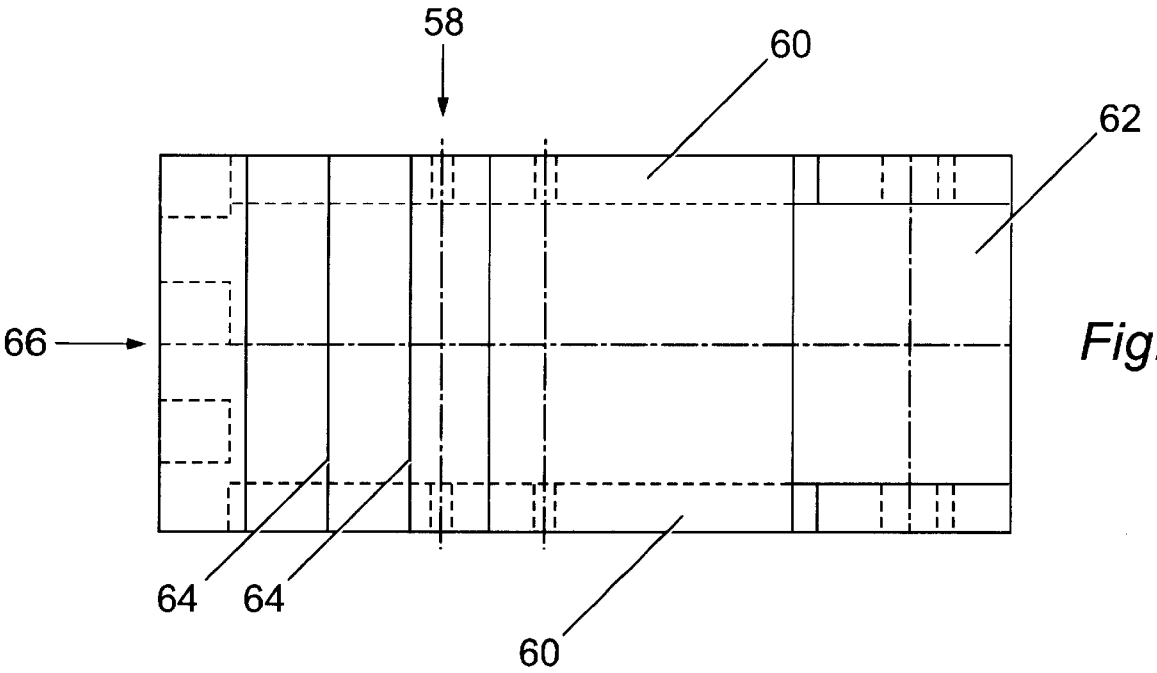
FIGS. 6*a* and 6*b* are plan and side views respectively of a plate member for use with the device of FIG. 4.
Figure 6B:
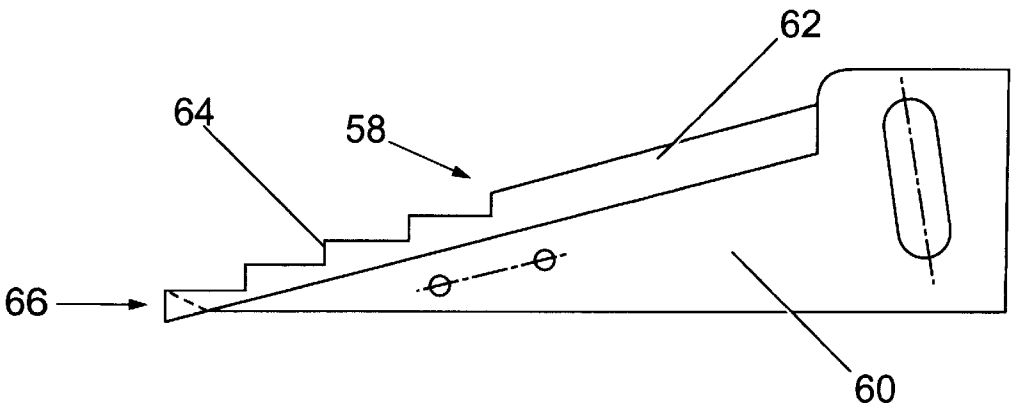

As best shown in FIGS. 6*a* and 6*b*, the plate members 58 comprise two legs 60 with a stepped plate 62 which spans the legs 60. The stepped plate 62 is conveniently welded to the legs 60 but may be secured by any conventional means such as counter-sunk bolts or the like, or may be formed as one with the legs 60.

The stepped plate 62 is provided with a plurality of steps 64 (see FIGS. 7*a* and 7*b*) which originate at the leading edge 66 of the device 50. The steps 64 provide a plurality of surfaces 68 which are used as contact surfaces when the device is in use, the exact function being described hereinafter.

Figure 7A:
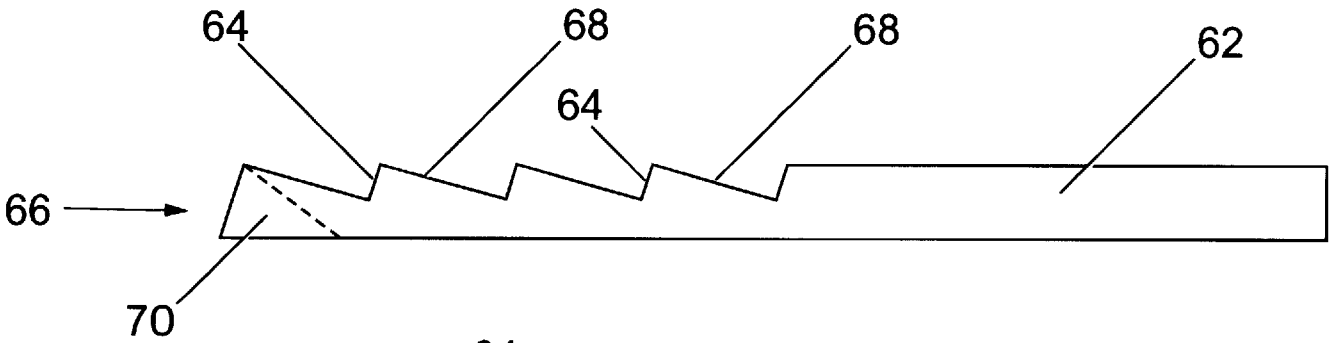
FIG. 7*a* and 7*b* are plan and side views respectively of a stepped member which constitutes a first component of the plate member of FIGS. 6*a* and 6*b*.
Figure 7B:
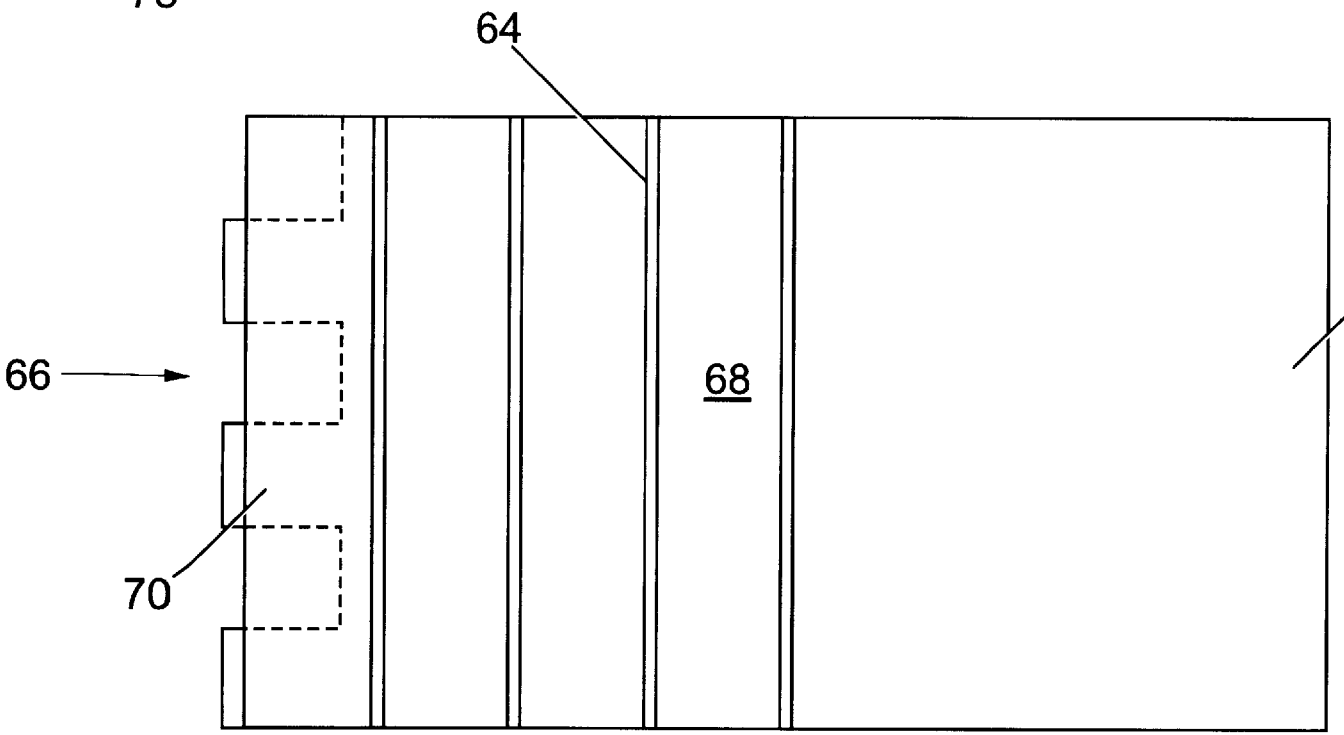

As best shown in FIGS. 7*a* and 7*b*, a series of castellations 70 are provided on the leading edge 66 of the stepped plate 62. This feature allows the width of the leading edge 66 to be reduced with regard to conventional separation devices. The castellations 70 on the plate member 58*a* are designed to fit between the castellations 70 on the plate member 58*b* such that the opposing plate members 58*a*, 58*b* can interfit with one another.

Figure 8A:
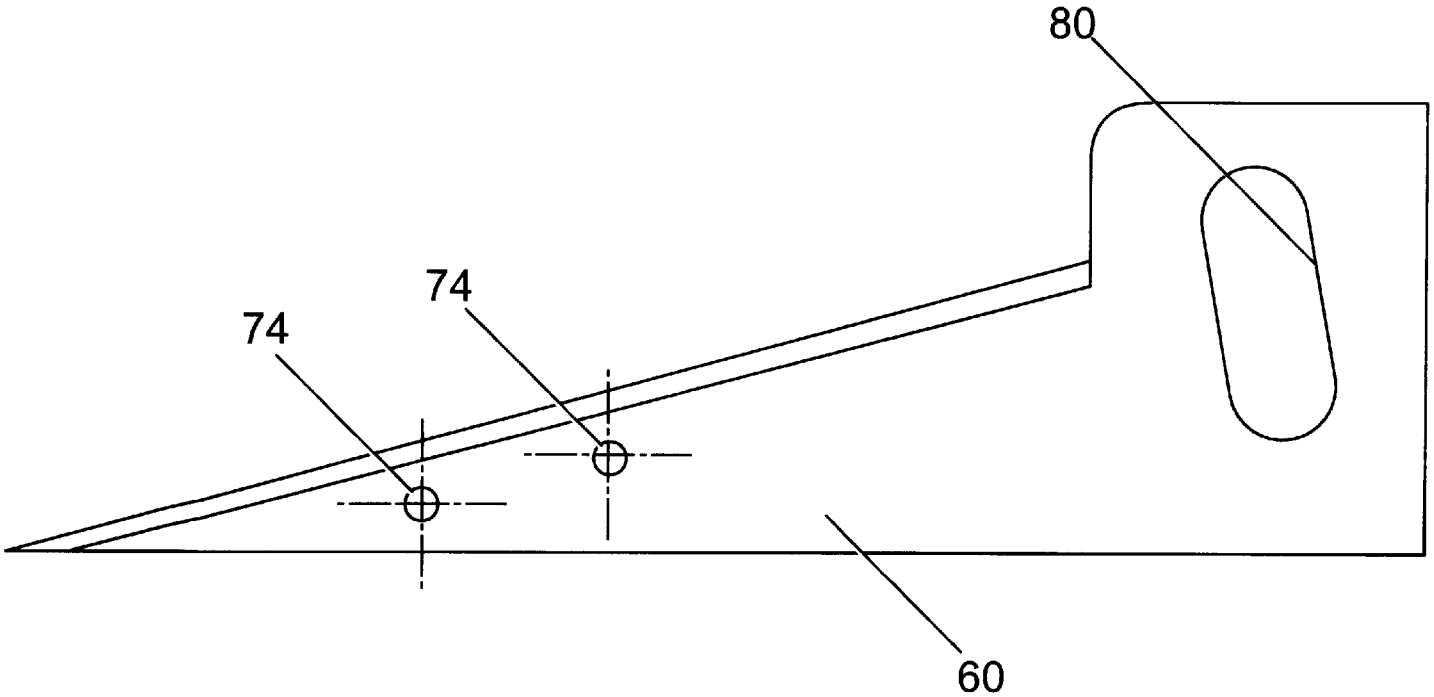
FIGS. 8*a* and 8*b* are side and plan views of a leg member which constitutes a second component of the plate member of FIGS. 6*a* and 6*b*.
Figure 8B:
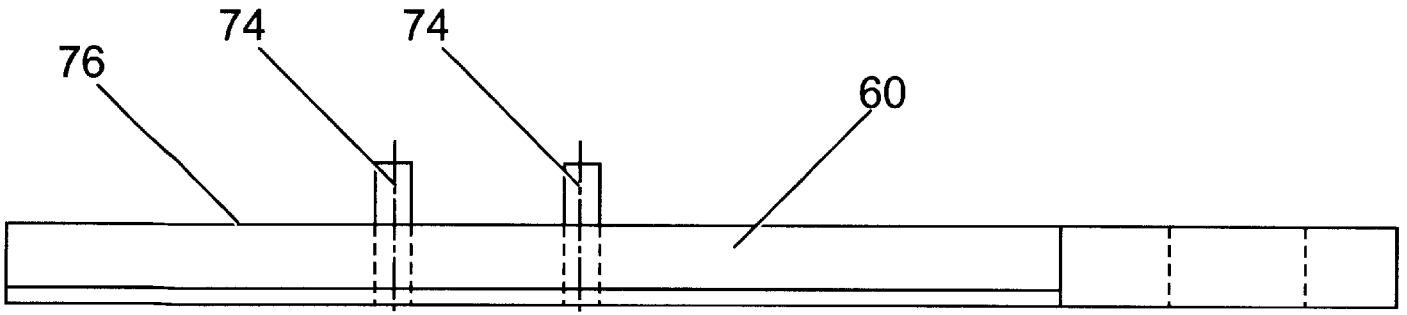

Referring now to FIGS. 8*a* and 8*b*, the legs 60 are provided with two pins 74 on an inner face 76 of the legs 60. The pins 74 are adapted to fit into corresponding slots 78 in the wedge 56 (see FIG. 5*a*) such that the plate members 58*a*, 58*b* are slidably coupled to the wedge 56. The slots 78 run parallel to the tapering surface of the wedge 56 and are provided on both side faces of the wedge 56 (only one face shown in FIG. 5*a*).

The legs 60 are further provided with a slot 80 in which a pin 82 located on the body member 54 is adapted to slide. The pin and slot arrangement (82, 80) is provided to stabilise the outward movement of the plate members 58*a*, 58*b* whilst the device 50 is in use. It will be appreciated that the slot 80 may be positioned on the body member 54 and correspondingly, the pin 82 may be positioned on the legs 60.

In use, the leading edge 66 of the device 50 is inserted into the space between two objects (not shown). The steps 64 provide parallel surfaces for abutting against the two objects so as to reduce the tendency for the device 50 to slip under load, and allow for the device 50 to be used with various sizes of spaces between the objects, the surfaces 68 providing the appropriate contact point.

The hydraulic ram 52 is actuated with the device 50 inserted between the two objects at the appropriate step size. The ram 52 extends towards the leading edge 66 of the device 50, and forces the wedge 56 in the direction of arrow 61*f* (FIG. 4), towards the apex of the wedge 56. While the wedge 56 is moving linearly in a direction towards its apex, the plate members 58*a*, 58*b* move in a direction which is substantially perpendicular to the direction of movement of the wedge 56. The pin and slot arrangement (82, 80) prevents the plate members 58*a*, 58*b* from twisting or skewing as the plate members 58*a*, 58*b* move outwards.

The hydraulic ram 52 forces the wedge 56 linearly outwards until the required gap is formed between the objects, or alternatively until the wedge 56 reaches its outer limit as shown in phantom in FIG. 4. Also shown in phantom in FIG. 4 is the outer extent of the plate member 58*a*. As can be seen from the drawing, the plate members 58*a*, 58*b* move slightly in the direction of the leading edge 66 of the device 50 due to the slight angle of the slot 80.

The extension of the plate members 58*a*, 58*b* forces apart the objects. Once the objects are forced apart, the two objects can be aligned for subsequent joining or alternatively, the fitting or replacement of a washer or other seal etc. It will be appreciated that the device 50 may be used as a jack for lifting an object from ground level for example.

When the operation has been performed, the hydraulic ram 52 is then retracted. As a result of the retraction of the ram 52, the wedge 56 is pulled towards the body 54 in the direction of arrow 61*r* (FIG. 4). As the wedge 56 retracts towards the body 54, the interengagement of pins 74 with the slots 78 results in the plate members 58*a*, 58*b* being retracted towards their initial position. Whereas in the prior art devices, the plate members had to be closed using, for example, force exerted upon them by hand, the pin 74 and slot 78 arrangement offers the advantage that the plate members 58*a*, 58*b* do not have to be physically forced back into position by some external means. The device 50 of the present invention provides for the plate members 58*a*, 58*b* closing as a consequence of the retraction of the wedge 56, due to the pin 74 and slot 78 arrangement.

Hence, the present invention provides a separation device which offers distinct advantages over prior art devices. Certain embodiments of the device are capable of operating either hydraulically or by hand. Furthermore, the addition of the interlocking feature in certain embodiments provides a device which is capable of being used in applications where there is only a small gap and the objects are such that a large expansive force is required to widen the gap.

Modifications and improvements may be incorporated without departing from the scope of the invention.

What is claimed is:

1. A separating device comprising a wedge-shaped member having an apex and an axis extending towards the apex mounted on a body member for movement along the axis of the wedge-shaped member, first and second plate members capable of movement in a direction substantially perpendicular to the direction of movement of the wedge-shaped member, the plate members each having a leading edge, and a linear dive mechanism to move the wedge-shaped member relative to the body member, wherein the leading edges of the first and second plate members have interfitting formations.

2. A separating device according to claim 1, wherein the two plate members are located on opposite tapering surfaces of the wedge-shaped member.

3. A separating device according to claim 1, wherein the plate members are constrained to move in a direction substantially perpendicular to the direction of movement of the wedge-shaped member.

4. A separating device according to claim 1, wherein the plate members are slidably coupled to the body member.

5. A separating device according to claim 1, wherein the plate members are slidably coupled to the wedge-shaped member.

6. A separating device according to claim 1, wherein the linear drive mechanism is coupled to the wedge-shaped member.

7. A separating device according to claim 1, wherein the plate members extend across a tapered surface of the wedge-shaped member and have legs which extend down the sides of the wedge-shaped member.

8. A separating device according to claim 7, wherein the legs are slidably coupled to the body member by a first pin and slot arrangement.

9. A separating device according to claim 8, wherein the first pin and slot arrangement comprises a pin in one of the plate members and the body member which engages with a corresponding slot in the other of the plate members and the body member.

10. A separating device according to claim 8, wherein two of the first pin and slot arrangements are provided for each plate member, one pin and slot arrangement being located on each side of the wedge-shaped member.

11. A separating device according claim 7, wherein the legs are slidably coupled to the wedge-shaped member by a second pin and slot arrangement.

12. A separating device according to claim 11, wherein the second pin and slot arrangement comprises at least one pin on an inner face of each leg of the plate members, said at least one pin engaging a respective slot formed in the wedge-shaped member.

13. A separating device according to claim 12, wherein the slot in the wedge-shaped member extends parallel to an edge of a tapered surface of the wedge-shaped member.

14. A separating device according to claim 11, wherein the second pin and slot arrangement comprises two pins on an inner face of each leg of the plate members, said two pins engaging a single slot formed in the wedge-shaped member.

15. A separating device according to claim 11, wherein the interengagement of the second pin with the second slot transfers force from the wedge-shaped member to promote retraction of the plate members as the wedge-shaped member is retracted using the drive mechanism.

16. A separating device according to claim 11, wherein the pins are provided on the wedge-shaped member and the slots are provided on the plate members.

17. A separating device according to claim 11, wherein two of the second pin and slot arrangements are provided for each plate member, one arrangement associated with each inner face of the legs of the plate members.

18. A separating device according to claim 1, wherein the plate members each have a stepped outer surface.

19. A separating device according to claim 1, wherein the plate members have castellated edges.

20. A separating device according to claim 1, wherein the plate members move in parallel but opposite directions.

21. A separating device according to claim 1, wherein the drive mechanism comprises a hydraulic ram.

22. A separating device according to claim 1, wherein the drive mechanism comprises a threaded stud which engages with a screw thread in the body member.

* * * * *

UNITED STATES PATENT AND TRADEMARK OFFICE

CERTIFICATE OF CORRECTION

PATENT NO. : 6,267,354 B1
DATED : July 31, 2001
INVENTOR(S) : Stephen

It is certified that error appears in the above-identified patent and that said Letters Patent is hereby corrected as shown below:

Column 5,
Line 45, should read, member, the first and second plate members being located on opposite tapering surfaces of the wedge-shaped member, the plate members each having a leading edge, and
Line 49, should read, tions such that one of the plate members interfits with the other of the plate members.
Line 50 thru Line 52, should be deleted.

Signed and Sealed this

Fourteenth Day of May, 2002

*Attest:*

*Attesting Officer*

JAMES E. ROGAN
*Director of the United States Patent and Trademark Office*